US008103182B2

(12) United States Patent
Seki et al.

(10) Patent No.: US 8,103,182 B2
(45) Date of Patent: Jan. 24, 2012

(54) IMAGE FORMING APPARATUS TAHT INCLUDES A TRANSFER MEMBER THAT CAN BE SEPARATED FROM AN INNER CIRCUMFERENTIAL SURFACE OF A TRANSFER BELT WHEN BELT IS ROTATING

(75) Inventors: Hiroyuki Seki, Mishima (JP); Yoshiro Saito, Susono (JP); Kazuhiro Funatani, Mishima (JP); Masahide Hirai, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 82 days.

(21) Appl. No.: 12/565,926

(22) Filed: Sep. 24, 2009

(65) Prior Publication Data

US 2010/0080597 A1 Apr. 1, 2010

(30) Foreign Application Priority Data

Sep. 29, 2008 (JP) ..... 2008-250527
Sep. 15, 2009 (JP) ..... 2009-213340

(51) Int. Cl.
*G03G 15/16* (2006.01)
*G03G 15/01* (2006.01)

(52) U.S. Cl. ..... 399/66; 399/302

(58) Field of Classification Search ..... 399/66, 399/85, 302

See application file for complete search history.

(56) References Cited

U.S. PATENT DOCUMENTS

| | | | | |
|---|---|---|---|---|
| 5,594,538 | A | 1/1997 | Takekoshi | |
| 5,893,017 | A | 4/1999 | Yamamoto | |
| 6,324,374 | B1 * | 11/2001 | Sasamoto et al. | 399/298 |
| 6,385,427 | B1 | 5/2002 | Nakane | |
| 6,738,594 | B2 * | 5/2004 | Nakagawa et al. | 399/299 |
| 7,599,651 | B2 * | 10/2009 | Kitagawa et al. | 399/302 |
| 7,664,444 | B2 * | 2/2010 | Mochizuki | 399/302 |
| 7,672,605 | B2 * | 3/2010 | Kayahara et al. | 399/66 |
| 2005/0069334 | A1 | 3/2005 | Hashimoto et al. | |

FOREIGN PATENT DOCUMENTS

| | | | |
|---|---|---|---|
| EP | 855627 | A2 | 7/1998 |
| JP | 10-207151 | A | 8/1998 |
| JP | 10-207308 | A | 8/1998 |

* cited by examiner

*Primary Examiner* — Sandra Brase
(74) *Attorney, Agent, or Firm* — Canon USA Inc IP Division

(57) ABSTRACT

An image forming apparatus includes a transfer roller that can be separated from an intermediate transfer belt. When an operational mode is switched from a multicolor mode to a mono-color mode, the image forming apparatus changes a rotational speed of the intermediate transfer belt to a level slower than a rotational speed of the intermediate transfer belt to be set in the multicolor mode to transfer a toner image to the intermediate transfer belt, then separates a first transfer member from the intermediate transfer belt, and after the first transfer member is separated from the intermediate transfer belt, the image forming apparatus increases the rotational speed of the intermediate transfer belt to a rotational speed to be set in the mono-color mode to transfer the toner image to the intermediate transfer belt.

13 Claims, 9 Drawing Sheets

INTERMEDIATE TRANSFER BELT SPEED IN CONTINUOUS PRINTING OF FULL-COLOR AND MONOCHROME IMAGES

INTERMEDIATE TRANSFER BELT SPEED IN PRINTING OF FULL-COLOR IMAGES

IMAGE FORMING APPARATUS TAHT INCLUDES A TRANSFER MEMBER THAT CAN BE SEPARATED FROM AN INNER CIRCUMFERENTIAL SURFACE OF A TRANSFER BELT WHEN BELT IS ROTATING

BACKGROUND OF THE INVENTION

1. Field of the Invention

The present invention relates to an image forming apparatus, such as a copying machine, a printer, or a facsimile machine, which can perform image formation according to an electrophotographic method.

2. Description of the Related Art

There is a conventional image forming apparatus, such as a copying machine or a page printer, which can perform image forming processing according to an electrophotographic method. The image forming apparatus according to the electrophotographic method can form a toner image on a material (e.g., paper) using electrostatic force. The image forming apparatus includes a fixing device that can apply heat and pressure to the toner image formed on the material to discharge a fixed toner image as an output image.

An electrophotographic process color image forming apparatus is widely used as one of the electrophotographic image forming apparatuses, which includes a transfer belt that can realize advanced functions such as color image formation and speedy printing.

FIG. 9 illustrates a schematic configuration of a conventional image forming apparatus including an intermediate transfer member in the form of an intermediate transfer belt 31. The image forming apparatus illustrated in FIG. 9 is an example of the color image forming apparatus that performs electrophotographic processes. The intermediate transfer belt 31 is stretched by three tension rollers 8, 10, and 34. The image forming apparatus illustrated in FIG. 9 includes yellow (Y), cyan (C), magenta (M), and black (Bk) process cartridges 32*a*, 32*b*, 32*c*, and 32*d*, which are independently disposed.

Each process cartridge includes a drum-shaped image carrier (hereinafter, referred to as a photosensitive drum) 2*a* to 2*d*. The photosensitive drum 2*a* to 2*d* is driven to rotate in a direction indicated by an arrow at a predetermined circumferential speed (i.e., a process speed). The photosensitive drum 2*a* to 2*d* is subjected to charging processing in the process of rotation described above. A primary charging device 3*a* to 3*d* can uniformly charge the photosensitive drum 2*a* to 2*d* to have an electric potential of a predetermined polarity.

Next, an image exposure unit 4*a* to 4*d* performs image exposure processing to form an electrostatic latent image corresponding to a first color component image (e.g., yellow component image), which is a target color image, on the photosensitive drum 2*a* to 2*d*. Next, a developing device 5*a* to 5*d* (more specifically, a yellow developing device 5*a*) develops the electrostatic latent image at a developing position to visualize the developed image as a toner image on the photosensitive drum 2*a*. The yellow toner image formed on the photosensitive drum 2*a* is then transferred from the photosensitive drum 2*a* to the intermediate transfer belt 31 (i.e., an elastic member having a medium resistance) at a primary transfer portion.

A primary transfer member 14*a* to 14*d* disposed on an inner circumferential surface side of the intermediate transfer belt 31 in a confronting relationship with the photosensitive drum 2*a* to 2*d*, and the intermediate transfer belt 31 cooperatively constitute the primary transfer portion.

Similarly, the cyan, magenta, and black process cartridges perform the above-described process for transferring the toner image formed on the photosensitive drum 2*a* to 2*d* to the intermediate transfer belt 31. As a result, a full color (i.e., 4-color) toner image is formed on the intermediate transfer belt 31. A secondary transfer member 35 integrally transfers the full color (i.e., 4-color) image formed on the intermediate transfer belt 31 to a transfer material S at a secondary transfer portion. A fixing apparatus 18 fuses and fixes the transferred image to form a color print image.

A cleaner apparatus removes secondary transfer residual toner (i.e., any toner remains on the intermediate transfer belt 31 without being transferred to the transfer material S) off the intermediate transfer belt 31 at the secondary transfer portion. The cleaner apparatus includes an elastic belt cleaning blade 33 disposed to face in a counter fashion against a rotational direction of the intermediate transfer belt 31. After the above-described image formation processing is completed, the primary transfer member 14*a* to 14*d* is separated from the intermediate transfer belt 31 and the intermediate transfer belt 31 stops rotating.

In general, an image forming apparatus capable of forming a color image can select its operational mode between a multicolor mode and a mono-color mode. The image forming apparatus selects the multicolor mode to perform image formation using a plurality of image formation units. The image forming apparatus selects the mono-color mode to perform image formation using only one image formation unit.

According to the image forming apparatus capable of switching its operational mode between the multicolor mode and the mono-color mode, if the photosensitive drum of an image formation unit that does not function for image formation in the mono-color mode is continuously engaged with the transfer belt, a surface of the photosensitive drum may be abraded by the transfer belt.

Hence, as discussed in Japanese Patent Application Laid-Open No. 10-207151, to prevent the photosensitive drum from being abraded when it does not function in the mono-color mode, it is useful to provide a mechanism for separating the photosensitive drum from a rotating transfer belt when the photosensitive drum does not function in the mono-color mode. According to the configuration discussed in Japanese Patent Application Laid-Open No. 10-207151, the photosensitive drum can be separated from the transfer belt by separating a transfer member disposed in an opposed relationship with the photosensitive drum that does not function in the mono-color mode.

However, in a case where the primary transfer member 14*a* to 14*d* is configured to be driven by the transfer belt 31, a surface of the primary transfer member may be frictionally abraded while the primary transfer member is frictionally engaged with the transfer belt when the primary transfer member is separated in a switching operation from the multicolor mode to the mono-color mode.

SUMMARY OF THE INVENTION

The present invention is directed to an image forming apparatus that includes a first transfer member that can be separated from an inner circumferential surface of a transfer belt when the transfer belt is rotating. The image forming apparatus according to the present invention can prevent the first transfer member from being frictionally abraded while the first transfer member is frictionally engaged with the transfer belt when the first transfer member is separated from the transfer belt.

According to an aspect of the present invention, an image forming apparatus includes a rotatable intermediate transfer belt, a first image carrier and a second image carrier each configured to carry a toner image, wherein the first image carrier and the second image carrier are located in a confronting relationship with the intermediate transfer belt and disposed along a rotational direction of the intermediate transfer belt, a first transfer member arranged on an opposite side of the intermediate transfer belt from the first image carrier, and a second transfer member arranged on an opposite side of the intermediate transfer belt from the second image carrier, wherein the image forming apparatus is configured to be switchable between a multicolor mode and a mono-color mode, cause, in the multicolor mode, the first image carrier and the first transfer member to be urged towards each other to allow transfer of toner images from the first image carrier onto the intermediate transfer belt, and the second image carrier and the second transfer member to be urged towards each other to allow transfer of toner images from the second image carrier onto the intermediate transfer belt, and then the intermediate transfer belt to secondarily transfer the superimposed toner images to a transfer material, and cause, in the mono-color mode, the second image carrier and the second transfer member to be urged towards each other to allow transfer of toner images from the second image carrier onto the intermediate transfer belt in a state where the first transfer member is separated from the intermediate transfer belt, and then the intermediate transfer belt to secondarily transfer the transferred toner image to the transfer material, wherein in that the image forming apparatus is configured to change a rotational speed of the intermediate transfer belt to a speed slower than a rotational speed of the intermediate transfer belt used in the multicolor mode during transfer of the toner image to the intermediate transfer belt in a case that the operational mode is switched from the multicolor mode to the mono-color mode, separate the first transfer member from the intermediate transfer belt, and increase, after the first transfer member is separated from the intermediate transfer belt, the rotational speed of the intermediate transfer belt to a rotational speed used in the mono-color mode to transfer the toner image to the intermediate transfer belt.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

However, constituent components described in the following exemplary embodiments can be modified appropriately in dimensions, material, shape, and relative layout according to a configuration of an apparatus to which the present invention can be applied as well as various conditions. Therefore, the scope of the present invention should not be narrowly limited to the below-described embodiments unless it is specifically mentioned.

Figure 1:
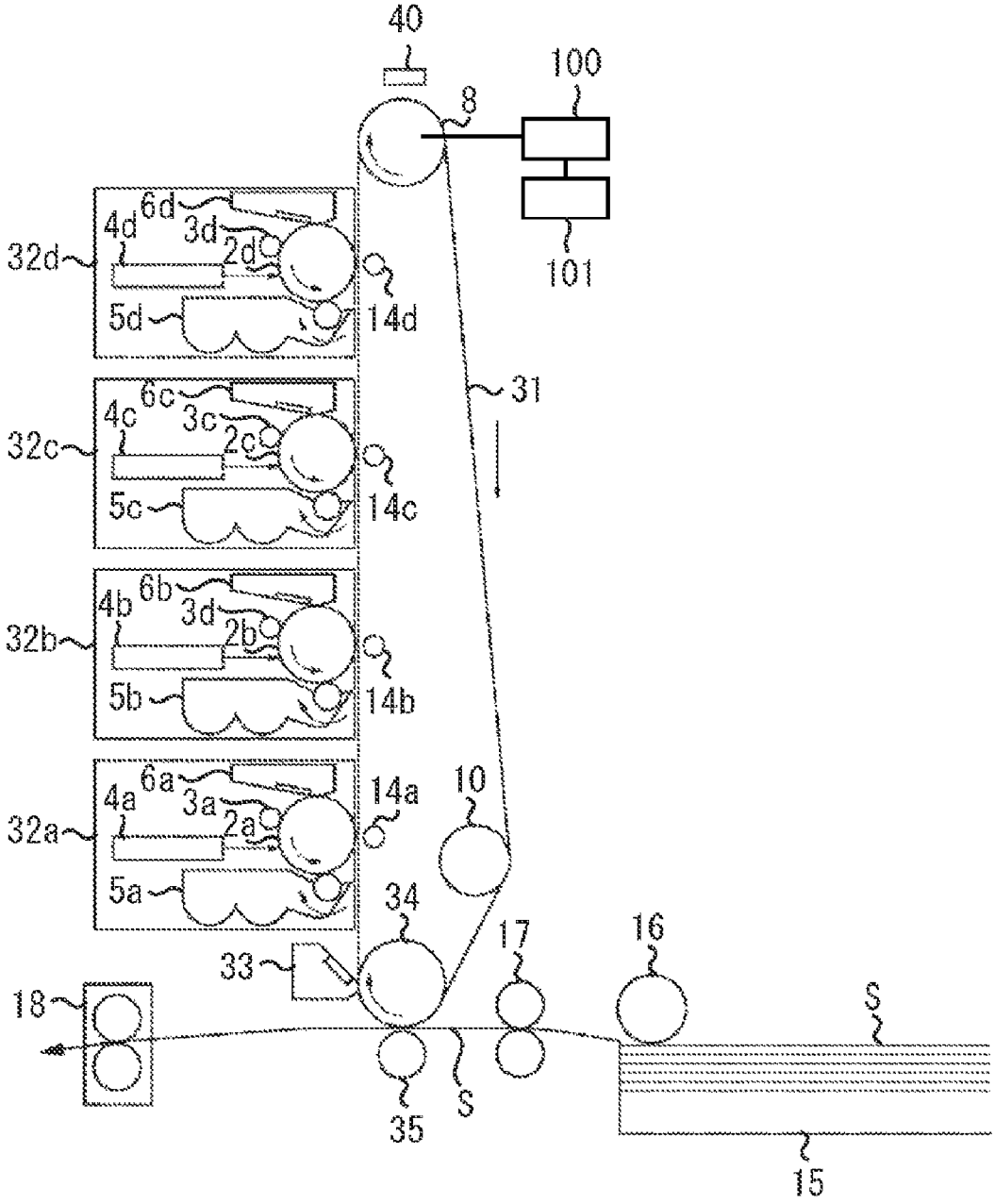
FIG. 1 illustrates an example of a schematic cross-sectional configuration of an image forming apparatus according to a first exemplary embodiment of the present invention.

FIG. 1 illustrates a schematic configuration of a color image forming apparatus using an intermediate transfer mechanism, which can serve as an image forming apparatus according to the present exemplary embodiment. The color image forming apparatus according to the present exemplary embodiment includes a tandem intermediate transfer mechanism, which includes a plurality of image formation units. More specifically, each image formation unit is equipped with an image carrier and is configured to form a toner image of a designated color.

The color image forming apparatus illustrated in FIG. 1 includes four independent process cartridges 32*a* to 32*d* dedicated to Y, M, C, and Bk colors, respectively. Each process cartridge 32*a* to 32*d* includes a photosensitive drum 2*a* to 2*d* serving as an image carrier, a developing device 5*a* to 5*d* that can develop a toner image on the photosensitive drum 2*a* to 2*d*, and a cleaning unit 6*a* to 6*d* that can remove residual toner (i.e., toner not having been transferred to an intermediate transfer member) off the photosensitive drum 2*a* to 2*d*. Each process cartridge 32 can be independently attached to or detached from an apparatus body.

The color image forming apparatus illustrated in FIG. 1 can sequentially transfer the toner images of respective colors from these process cartridges 32 to the intermediate transfer member 31 in such a way to laminate all images at a same position on the intermediate transfer member 31. Then, the color image forming apparatus can integrally transfer the laminated images onto a transfer material S to obtain a full-color image. The transfer material S can be fed from a paper feeding unit 15 and can be discharged to a discharge tray (not illustrated). Hereinafter, a detailed configuration of a yellow process cartridge 32*a* and operations to be performed by the yellow process cartridge 32*a* are described below. Other process cartridges 32*b* to 32*d* have similar configuration and operations.

The photosensitive drum 2*a* to 2*d* is an electrophotographic photosensitive member having a rotary drum body that can be repetitively used. The photosensitive drum 2*a* to 2*d* can be driven to rotate in a predetermined direction at a predetermined circumferential speed (i.e., a process speed). The process speed of the image forming apparatus according to the present exemplary embodiment is variable depending on the type of the transfer material S.

For example, the process speed of the image forming apparatus may be set to 180 mm/sec for a plain paper having a grammage value in a range from 75 g/m$^2$ to 105 g/m$^2$. Further, the process speed of the image forming apparatus may be set to 90 mm/sec for a thick paper having a grammage value in a range from 106 g/m$^2$ to 128 g/m$^2$ and for a glossy paper, an envelope, or a label paper having a grammage value in a range from 91 g/m$^2$ to 130 g/m$^2$. Moreover, the process speed of the image forming apparatus may be set to 60 mm/sec for a thick paper having a grammage value in a range from 129 g/m$^2$ to 216 g/m$^2$ and for a glossy paper having a grammage value in a range from 131 g/m$^2$ to 220 g/m$^2$.

As described above, the image forming apparatus according to the present exemplary embodiment can operate at three different process speeds. More specifically, in the present exemplary embodiment, the image forming apparatus can change the circumferential speed (i.e., the process speed) of the photosensitive drum 2*a* to 2*d* according to the type of the transfer material S. The following table 1 summarizes the above-described process speeds that can be set for various types of paper.

TABLE 1

| Transfer Material | Grammage (g/m$^2$) | Process Speed (mm/sec) |
|---|---|---|
| Plain Paper | 75 to 1005 | 180 |
| Thick Paper | 106 to 128 | 90 |
| Glossy Paper | 91 to 130 | 90 |
| Envelope | — | 90 |
| Label Paper | — | 90 |
| Thick Paper | 129 to 216 | 60 |
| Glossy Paper | 131 to 220 | 60 |

A primary charging roller 3*a* to 3*d* can uniformly charge the photosensitive drum 2*a* to 2*d*, which can serve as an image carrier, so that the photosensitive drum 2*a* to 2*d* has an electric potential of a predetermined polarity (i.e., a voltage of a negative polarity in the first exemplary embodiment). An exposure unit (which may be configured to include a laser diode, a polygonal scanner, and a lens group) 4*a* can irradiate the photosensitive drum 2*a* with light to form an electrostatic latent image corresponding to a yellow component.

Next, a developing unit 5*a* develops (visualize) an electrostatic latent image formed on the photosensitive drum 2*a* with a yellow toner. The developing unit 5*a* includes a toner container that stores a predetermined capacity of toner and a developing roller that carries and conveys the toner.

The developing roller may be made of an elastic rubber having been resistance adjusted. The developing roller rotates in a forward direction relative to the photosensitive drum 2*a* in contact with the photosensitive drum 2*a*. When a voltage having a predetermined polarity (a voltage having a negative polarity according to the present exemplary embodiment) is applied to the developing roller, the toner frictionally charged to have a same polarity and carried on the developing roller in each developing device can be transferred onto the photosensitive drum 2*a* to form an electrostatic latent image.

The intermediate transfer member according to the present exemplary embodiment is the intermediate transfer belt 31 that is rotatable. A driving roller 8, which is one of the tension rollers, can drive the intermediate transfer belt 31 to rotate in a predetermined direction at a circumferential speed identical to that of the photosensitive drum 2*a* to 2*d* in contact with the photosensitive drum 2*a* to 2*d*.

A driving source 100 drives the driving roller 8. A control unit 101 (i.e., a controller) controls the driving source 100. The control unit 101 can control a rotational speed of the intermediate transfer belt 31 to an appropriate one of a plurality of speed levels (180 mm/sec, 90 mm/sec, and 60 mm/sec) according to a process speed of the photosensitive drum 2*a* to 2*d*. The intermediate transfer belt 31 is an endless film member that has a specific volume resistance value in a range from $10^8$ Ω·cm to $10^{12}$ Ω·cm and a thickness of 65 μm.

A primary transfer member is disposed in confronting relationship with the photosensitive drum 2*a* to 2*d* via the intermediate transfer belt 31. In the present exemplary embodiment, the primary transfer member is a primary transfer roller 14*a* that is rotatable. Further, the primary transfer roller 14*a* can be driven (i.e., rotated) by the intermediate transfer belt 31 when the primary transfer roller 14*a* receives the rotation power of the intermediate transfer belt 31. The primary transfer roller 14*a* does not rotate when the primary transfer roller 14*a* does not receive the rotation power of the intermediate transfer belt 31. The primary transfer roller 14*a* is made of a material having a lower hardness. For example, the primary transfer roller 14*a* is a resistance adjusted sponge rubber roller that has a hardness value in a range from 17° to 23° (according to the Asker-C hardness) and a specific volume resistance value in a range from $10^6$ Ω·cm to $10^7$ Ω·cm.

In the present exemplary embodiment, a rotational shaft of the primary transfer roller 14*a* is located on the downstream side of a rotational shaft of the opposing photosensitive drum 2*a* in a moving direction of the intermediate transfer belt 31. An effect brought by providing the rotational shaft of the primary transfer roller 14*a* on the downstream side in moving direction is capability of eliminating any image defectiveness that may be caused by electric discharge generated between the primary transfer roller 14*a* and the photosensitive drum 2*a*.

To secure a sufficient transfer nip width between the primary transfer roller 14*a* and the photosensitive drum 2*a* in a state where the rotational shaft is disposed on the downstream side, the primary transfer roller 14*a* according to present exemplary embodiment is constituted by the sponge rubber roller having a lower hardness value in a range from 17° to 23°. The sponge rubber roller having the hardness value in the range from 17° to 23° is an elastic member having an elastic coefficient value lower than that of the intermediate transfer belt 31. The photosensitive drum 2*a* and the primary transfer roller 14*a*, which are opposed to each other via the intermediate transfer belt 31, form a primary transfer nip portion.

When a toner image carried by the photosensitive drum 2*a* passes through the primary transfer portion, the toner image can be transferred from the photosensitive drum 2*a* to the intermediate transfer belt 31 under an electrostatic function obtained by the positive voltage applied to the primary transfer roller 14*a*. The cleaning blade of the cleaning unit 6*a* can remove primary transfer residual toner that remains on the photosensitive drum 2*a* after the above-described toner image transfer from the photosensitive drum 2*a* to the intermediate transfer belt 31 is completed.

Similar to the yellow process cartridge 32*a*, the cyan, magenta, and black process cartridges 32*b*, 32*c*, and 32*d* perform the above-described image formation processing to superimpose color toner images on the intermediate transfer belt 31. A secondary transfer roller 35 transfers the superimposed color toner images from the intermediate transfer belt 31 to the transfer material S.

The image forming apparatus according to the present exemplary embodiment includes the counter roller 34, which is brought into contact with an inner circumferential surface of the intermediate transfer belt 31. The secondary transfer roller 35 is disposed on an outer circumferential surface side of the intermediate transfer belt 31 in a confronting relationship with the counter roller 34. The counter roller 34 and the opposed secondary transfer roller 35 forms a secondary transfer nip portion via the intermediate transfer belt 31. The secondary transfer roller 35 is a resistance adjusted roller having a specific volume resistance value in a range from $10^7$ Ω·cm to $10^9$ Ω·cm.

The transfer material S is fed from the paper feeding unit 15, via roller 16, and is further guided toward the secondary transfer nip portion by a pair of registration rollers 17, which is driven to rotate at predetermined timing. The toner image (i.e., unfixed toner image) carried on the intermediate transfer belt 31 is transferred onto the transfer material S under an electrostatic function obtained by the positive voltage applied to the secondary transfer roller 35.

A fixing device 18 performs heat pressing on the transfer material S to fix the full-color toner image carried thereon. Then, the fixing device 18 discharges the processed transfer material S to the outside of the image forming apparatus body. A belt cleaning blade 33, which is a cleaning unit according to the present exemplary embodiment, removes secondary transfer residual toner that remains on the intermediate transfer belt 31 after the above-described toner image transfer from the intermediate transfer belt 31 to the transfer material S is completed.

An example of a configuration of the intermediate transfer belt equipped in the above-described image forming apparatus is described below. Three tension rollers are disposed at appropriate positions along an inner surface of the intermediate transfer belt 31. The driving roller 8 includes a metal cored rod surrounded by a coating layer of a silicone rubber having a thickness of 75 μm. The driving roller 8 can serve as a counter roller of an optical detection sensor 40.

The optical detection sensor 40 includes an LED light-emitting element, a light-receiving element, and a holder. The optical detection sensor 40 causes the light-emitting element to irradiate a toner patch or a line on the intermediate transfer belt 31 with an infrared ray. Then, the optical detection sensor 40 causes the light-receiving element to measure reflection light to calculate a toner adhesion amount or a positional deviation of the transferred toner. Thus, the optical detection sensor 40 can be used to perform image density control and color misregistration control.

The counter roller 34, which is in an opposed relationship with the secondary transfer roller 35, has a function of forming a nip to transfer the toner image from the intermediate transfer belt 31 to the transfer material S at the secondary transfer portion. The counter roller 34 has another function of tightly holding the intermediate transfer belt 31 to enable the cleaning blade to remove the secondary transfer residual toner from the belt under a predetermined pressure.

The counter roller 34 includes a metal cored rod surrounded by a coating layer of an ethylene propylene rubber having a thickness of 2 mm. The counter roller 34 is 74±5° (JIS-A) in hardness and is equal to or less than $10^5$ Ω·cm in volume resistance. The intermediate transfer belt 31 is also stretched around the tension roller 10 that has a metal surface having a surface roughness equal to or less than Ra=3.2 μm.

The arrangement for stretching the intermediate transfer belt 31 around three tension rollers 8, 10, and 34 brings an effect of appropriately forming a nip shape at the secondary transfer nip portion and regulating a distance relationship between transfer material and the intermediate transfer belt 31. The above-described stretching arrangement can further bring an effect of preventing the image quality from being deteriorated due to abnormal discharge in image formation or splashing of toner.

The primary transfer roller 14*a* to 14*d* can be brought into contact with the intermediate transfer belt 31 and can be separated from the intermediate transfer belt 31. More specifically, in a case where no image is formed, primary transfer roller 14*a* to 14*d* does not contact the intermediate transfer belt 31. In a state where the primary transfer roller 14*a* to 14*d* is separated from the intermediate transfer belt 31, the intermediate transfer belt 31 can be separated from the photosensitive drum 2*a* to 2*d*.

Separating the photosensitive drum 2*a* to 2*d* from the intermediate transfer belt 31 brings an effect of preventing a surface of the photosensitive drum 2*a* to 2*d* from being frictionally abraded by the intermediate transfer belt 31 while the intermediate transfer belt 31 is rotating. Reducing a contact time during which the photosensitive drum 2*a* to 2*d* is brought into contact with the intermediate transfer belt 31 is effective to reduce an amount of abrasion that may be formed on the surface of the photosensitive drum 2*a* to 2*d*.

The color image forming apparatus having the above-described configuration can switch its operational mode between a multicolor mode and a mono-color mode. In the multicolor mode, the color image forming apparatus uses a plurality of photosensitive drums 2*a* to 2*d* corresponding to Y, M, C, and Bk in the image formation on the transfer material S to form a full-color image. In the mono-color mode, the color image forming apparatus uses only one photosensitive drum 2*d* corresponding to Bk to form a monochrome image.

The multicolor mode is a mode where a nip portion is formed between a first transfer member and a first image carrier via the intermediate transfer belt, and further a nip portion is formed between a second transfer member and a second image carrier via the intermediate transfer belt, to primarily transfer toner images from the first image carrier and the second image carrier to the intermediate transfer belt.

For example, in the present exemplary embodiment, the Y, M, and C photosensitive drums 2*a*, 2*b*, and 2*c* can serve as the first image carrier. The Bk photosensitive drum 2*d* can serve as the second image carrier. The primary transfer rollers 14*a*, 14*b*, and 14*c* can serve as the first transfer member. The primary transfer roller 14*d* can serve as the second transfer member.

The mono-color mode is a mode where the first transfer member is separated from the intermediate transfer belt, and further the nip portion is formed between the second transfer member and the second image carrier via the intermediate transfer belt, to primarily transfer the toner image from second image carrier to the intermediate transfer belt.

Figure 2:
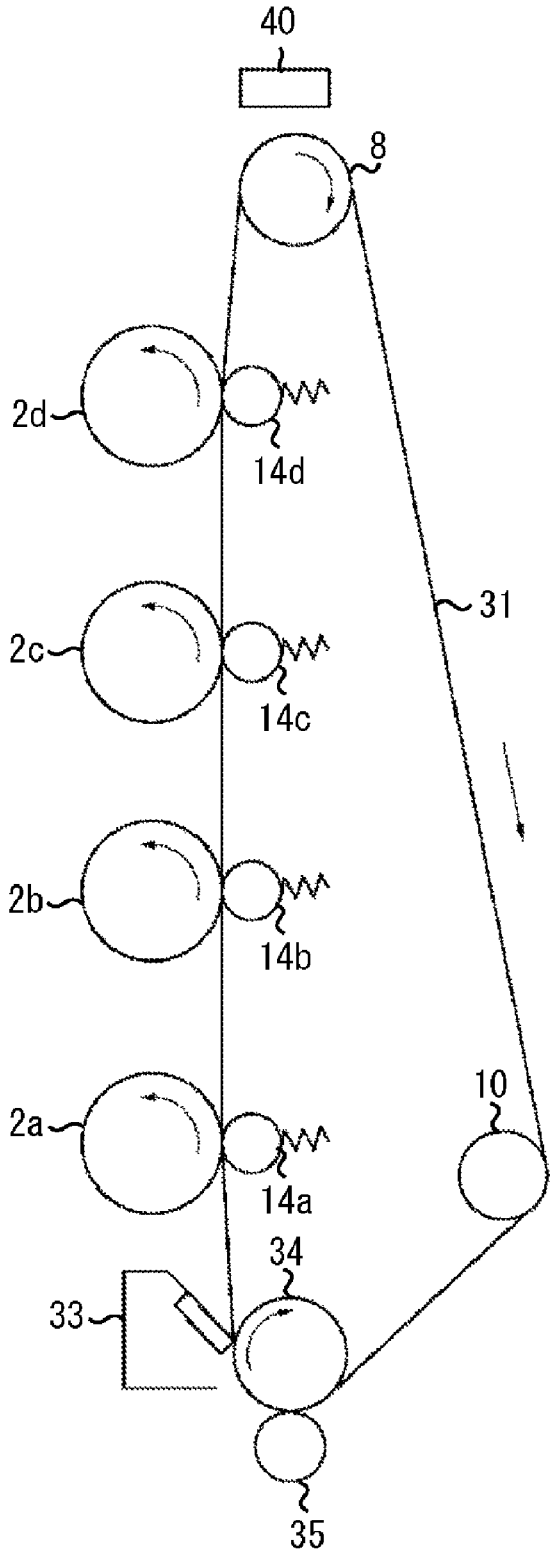
FIG. 2 schematically illustrates a status of a transfer member in a multicolor mode according to the first exemplary embodiment of the present invention.

When the color image forming apparatus performs multicolor printing in the multicolor mode according to the present exemplary embodiment, the color image forming apparatus brings the Y, M, C, and Bk primary transfer rollers 14*a* to 14*d* into contact with the intermediate transfer belt 31 in a primary transfer operation as illustrated in FIG. 2.

Figure 3:
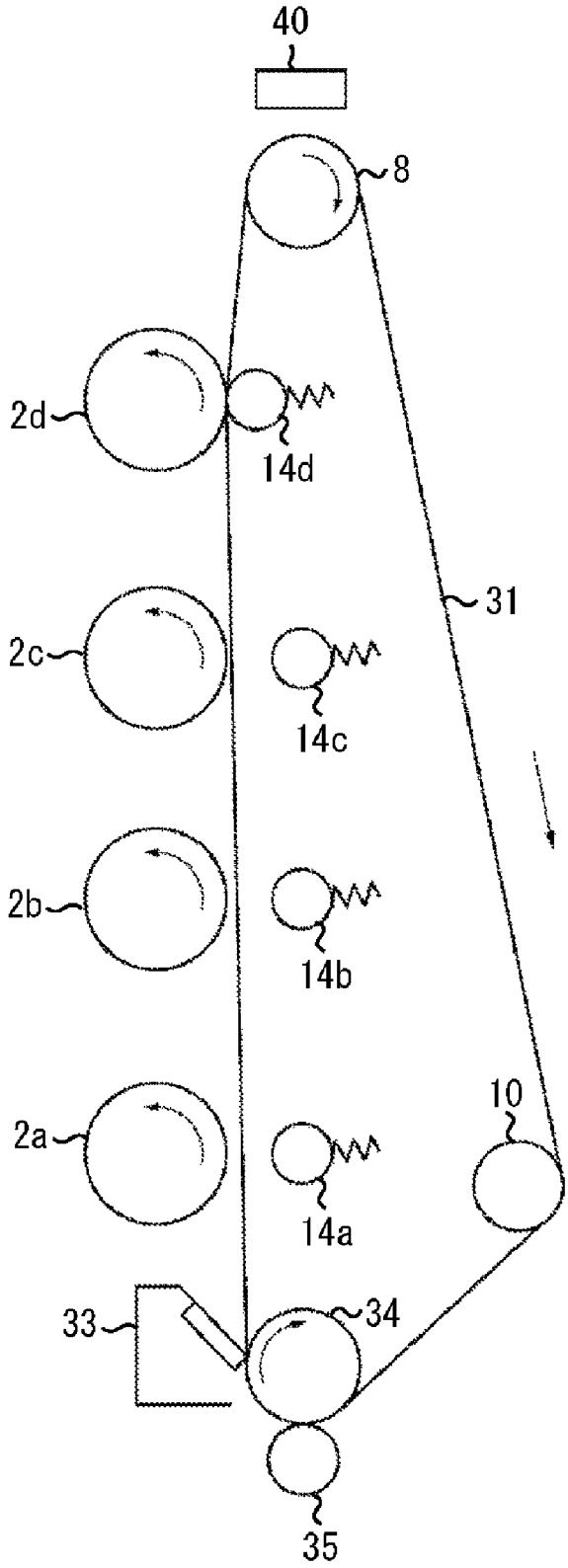
FIG. 3 schematically illustrates a status of the transfer member in a mono-color mode according to the first exemplary embodiment of the present invention.

On the other hand, when the color image forming apparatus performs mono-color printing in the mono-color mode according to the present exemplary embodiment, the color image forming apparatus separates the Y, M, and C primary transfer rollers 14*a*, 14*b*, and 14*c* from the intermediate transfer belt 31 and brings only the Bk primary transfer roller 14*d* into contact with the intermediate transfer belt 31 as illustrated in FIG. 3. Thus, the color image forming apparatus can prevent the surfaces of the Y, M, and C photosensitive drums 2*a* to 2*d* from being frictionally abraded by the intermediate transfer belt 31.

Figure 4:
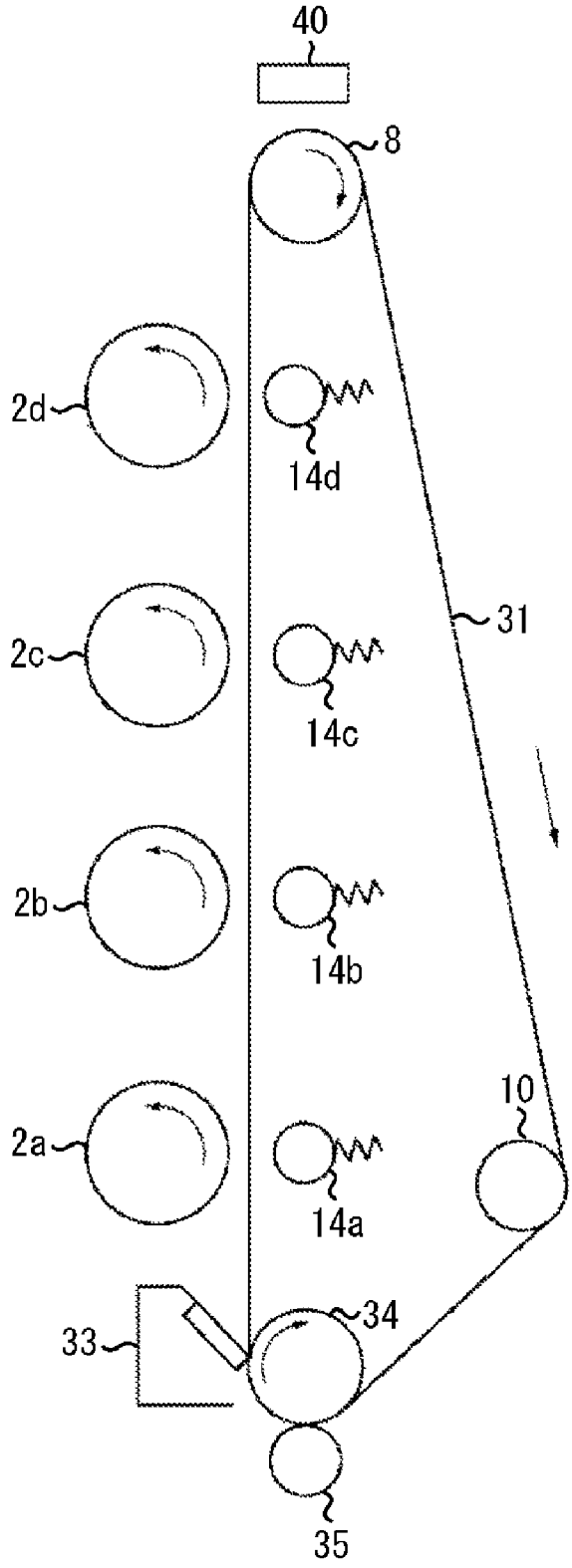
FIG. 4 schematically illustrates a status of the transfer member in a separated mode according to the first exemplary embodiment of the present invention.

Further, in a case where no image is formed, the primary transfer rollers 14*a* to 14*d* of all stations are separated from the intermediate transfer belt 31 as illustrated in FIG. 4.

The mode in which all the transfer rollers 14*a* to 14*d* are separated from the intermediate transfer belt 31, as illustrated in FIG. 4, is defined as a separated mode. As described above, engaging and separating operations to be performed for the primary transfer roller 14*a* to 14*d* according to the present exemplary embodiment can be classified into a total of three patterns, as summarized in table 2.

TABLE 2

| Mode | Engagement/separation state | Apparatus operational status |
|---|---|---|
| Multicolor mode | Fully engaged | Full-color image forming operation (density control, color misregistration control) |
| Mono-color mode | Partly engaged (only Bk) | Monochrome image forming operation |
| separated mode | Fully separated | Non-image forming operation |

In the image forming operation, the primary transfer roller 14*a* to 14*d* can be brought into contact with the intermediate transfer belt 31 that is rotating. The primary transfer roller 14*a* to 14*d* is driven by the intermediate transfer belt 31 that is rotating. After the image formation operation is completed, the primary transfer roller 14*a* to 14*d* is separated from the intermediate transfer belt 31 that is rotating.

At the moment when the primary transfer roller 14*a* to 14*d* is engaged with the intermediate transfer belt 31, or when the primary transfer roller 14*a* to 14*d* is disengaged from the intermediate transfer belt 31, a frictional force between the intermediate transfer belt 31 and the primary transfer roller 14*a* to 14*d* becomes larger. Therefore, a large load acts on the sponge portion of the primary transfer roller 14*a* to 14*d*. This is because a large circumferential speed difference is generated between the primary transfer roller 14*a* to 14*d* and the intermediate transfer belt 31 in a state where the primary transfer roller 14*a* to 14*d* is completely separated from the intermediate transfer belt 31 and not driven by the intermediate transfer belt 31.

Therefore, if the rotational speed of the intermediate transfer belt 31 is faster in the engaging or separating operation, the circumferential speed difference between the intermediate transfer belt 31 and the primary transfer roller 14*a* to 14*d* becomes larger. A large load acts on the primary transfer roller 14*a* to 14*d*. Further, when the engaging and separating operations are repetitively performed, the surface sponge portion of the primary transfer roller 14*a* to 14*d* may be partly removed off and fall from the primary transfer roller 14*a* to 14*d* due to a frictional engagement with the intermediate transfer belt 31. The fallen sponge is a fragmented piece having a size in a range from 500 μm to 600 μm. Therefore, a fallen fragmented sponge can adhere to the inner circumferential surface of the intermediate transfer belt 31 and can be conveyed by the intermediate transfer belt 31 until it reaches and adheres to the driving roller 8, the counter roller 34, or the tension roller 10.

For example, a fallen fragmented sponge may adhere to the driving roller 8 that is disposed in an opposed relationship with the optical detection sensor 40. If the fragmented sponge adheres to the driving roller 8, the optical detection sensor 40 receives reflection light from the fragmented sponge adhered to the driving roller 8 in addition to the reflection light from the toner patch. In other words, the optical detection sensor 40 is adversely influenced by the fragmented sponge that appears in synchronization with the rotation of the driving roller 8. The optical detection sensor 40 cannot accurately perform optical detection.

Therefore, the fallen fragmented sponge possibly deteriorates accuracy in the image density control or in the color misregistration control or causes a control error. Furthermore, if a fallen fragmented sponge adheres to the secondary transfer roller 35 and the counter roller 34, which is disposed in an opposed relationship with the cleaning blade, the transfer current to be flowed from the secondary transfer roller 35 to the counter roller 34 via the adhesion portion may become insufficient.

Therefore, the above-described adhesion of the fragmented sponge may cause transfer failures. If the intermediate transfer belt is deformed by the adhesion of the fragmented sponge, the cleaning blade may be damaged or worn out. Therefore, the adhesion of the fragmented sponge may also induce cleaning failures.

To prevent any occurrence of the above-described transfer failure or cleaning failure, it is necessary to prevent the primary transfer roller 14*a* to 14*d* from frictionally engaging with the intermediate transfer belt 31 in a switching operation between the multicolor mode and the mono-color mode. In other words, it is necessary to prevent the primary transfer roller 14*a* to 14*d* from being frictionally abraded by the intermediate transfer belt 31.

If the circumferential speed difference between the primary transfer roller 14*a* to 14*d* and the intermediate transfer belt 31 is small when the primary transfer roller 14*a* to 14*d* separates from the intermediate transfer belt 31, the load acting on the primary transfer roller 14*a* to 14*d* to be caused by a frictional engagement with the intermediate transfer belt 31 is a small. For example, if the primary transfer roller 14*a* to 14*d* is separated from the intermediate transfer belt 31 in a state where the circumferential speed difference between the primary transfer roller 14*a* to 14*d* and the intermediate transfer belt 31 is 0, namely, in a state where the rotational speed of the intermediate transfer belt 31 is 0, the load acting on the primary transfer roller 14*a* to 14*d* is small.

However, if the primary transfer roller 14*a* to 14*d* continuously engages with the intermediate transfer belt 31 until both the intermediate transfer belt 31 and the primary transfer roller 14*a* to 14*d* stop, the surface of the photosensitive drum 2*a* to 2*d* tends to be frictionally abraded because of a long lasting engagement between the photosensitive drum 2*a* to 2*d* and the intermediate transfer belt 31. Further, if the primary transfer roller 14*a* to 14*d* is separated from the intermediate transfer belt 31 after the intermediate transfer belt 31 stops in a switching operation from the multicolor mode to the mono-color mode, relatively long time is required to complete the mode switching operation and the throughput may decrease.

In view of the foregoing, the present exemplary embodiment intends to prevent the photosensitive drum 2*a* to 2*d* from being abraded and to reduce the time required to the mode switching operation. To this end, the present exemplary embodiment controls the rotational speed of the intermediate transfer belt 31 when the primary transfer roller 14*a* to 14*d* is engaged with or separated from the intermediate transfer belt 31.

Figure 5:
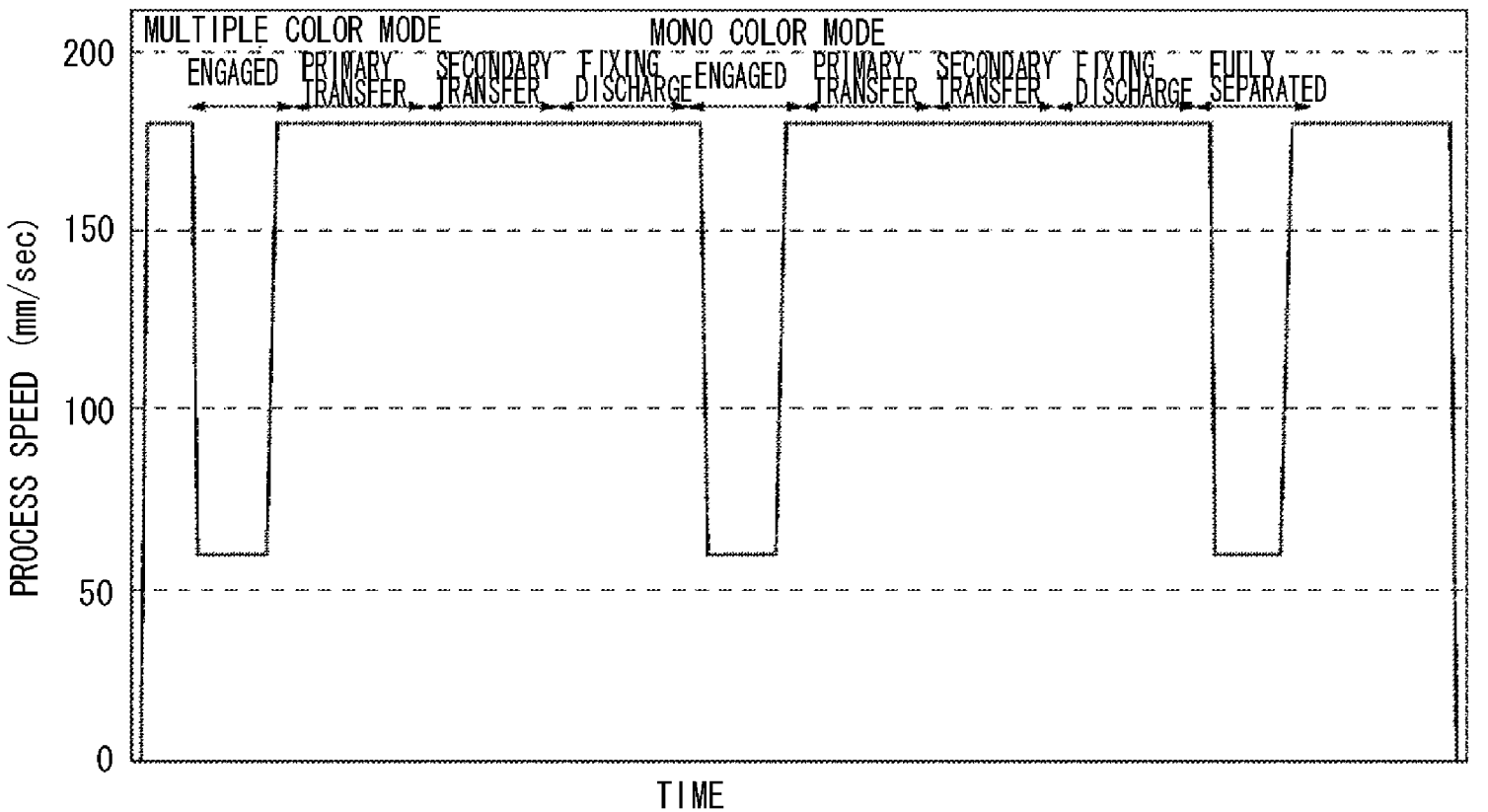
FIG. 5 illustrates an example of speed control for an intermediate transfer belt when mode is switched between the multicolor mode and the mono-color mode according to the first exemplary embodiment of the present invention.

An example of speed control for the intermediate transfer belt 31 in the image forming operation according to the present exemplary embodiment is described below with reference to FIGS. 5 and 6.

If an image formation start signal is input to the image forming apparatus, the photosensitive drum 2*a* to 2*d* is driven to rotate in a predetermined direction at a process speed corresponding to the transfer material S. The control unit 101 controls the rotational speed of the intermediate transfer belt 31 according to the process speed.

In the present exemplary embodiment, for example, in a case where the image forming apparatus performs image formation on a plain paper according to the multicolor mode, both the photosensitive drum 2*a* to 2*d* and the intermediate transfer belt 31 rotate at 180 mm/sec. Similarly, in a case where the image forming apparatus performs image formation on a plain paper according to the mono-color mode, both the photosensitive drum 2*a* to 2*d* and the intermediate transfer belt 31 rotate at 180 mm/sec.

An example of speed control for the intermediate transfer belt 31 in a switching operation from the multicolor mode to the mono-color mode is described below with reference to FIG. 5.

At the moment when the image forming apparatus completes the image formation on a plain paper in the multicolor mode, the intermediate transfer belt is rotating at 180 mm/sec. When the operation mode is switched to the mono-color mode, the control unit 101 decreases the rotational speed of the intermediate transfer belt 31 to 60 mm/sec in a state where the primary transfer roller 14*a* to 14*d* is engaged with the intermediate transfer belt 31.

In the state where the rotational speed of the intermediate transfer belt 31 is set to 60 mm/sec, the image forming apparatus separates the primary transfer rollers 14*a*, 14*b*, and 14*c* (i.e., apart of the plurality of primary transfer rollers 14*a* to 14*d*) from the intermediate transfer belt 31 because the primary transfer rollers 14*a*, 14*b*, and 14*c* are not used in the mono-color mode. After the primary transfer rollers 14*a*, 14*b*, and 14*c* are separated from the intermediate transfer belt 31, the control unit 101 changes the rotational speed of the intermediate transfer belt 31 to 180 mm/sec, which is a rotational speed to be set when the image forming apparatus performs image formation on a plain paper in the mono-color mode.

More specifically, when the image forming apparatus switches its operational mode from the multicolor mode to the mono-color mode, the control unit 101 changes the rotational speed of the intermediate transfer belt 31 to a level slower than the rotational speed of the intermediate transfer belt 31 to be set in the multicolor mode to transfer toner images onto the intermediate transfer belt 31.

Then, the first transfer member (i.e., the primary transfer rollers 14*a*, 14*b*, and 14*c*) is separated from the intermediate transfer belt 31. After the first transfer member is separated from the intermediate transfer belt 31, the control unit 101 increases the rotational speed of the intermediate transfer belt 31 to a level to be set in the mono-color mode to transfer a toner image onto the intermediate transfer belt 31.

In the present exemplary embodiment, when the image forming apparatus switches its operational mode from the mono-color mode to the multicolor mode, the control unit 101 performs speed control similar to the above-described control performed in the switching operation from the multicolor mode to the mono-color mode. More specifically, when the image forming apparatus switches its operational mode from the mono-color mode to the multicolor mode, the control unit 101 changes the rotational speed of the intermediate transfer belt 31 to a level slower than the rotational speed of the intermediate transfer belt 31 to be set in the mono-color mode to transfer a toner image onto the intermediate transfer belt 31.

Then, the first transfer member (i.e., the primary transfer rollers 14*a*, 14*b*, and 14*c*) is engaged with the intermediate transfer belt 31. After the first transfer member is brought into contact with the intermediate transfer belt 31, the control unit 101 increases the rotational speed of the intermediate transfer belt 31 to a level to be set in the multicolor mode to transfer toner images onto the intermediate transfer belt 31.

Effects of the above-described speed controls according to the present exemplary embodiment are described below based on experimental results obtained in the following endurance test.

The primary transfer roller 14*a* to 14*d* used in the endurance test is an elastic roller made of a material containing nitrile-butadiene rubber (NBR) and hydrin and having an outer diameter of ϕ14 and a hardness value of 20° (Asker-C). The intermediate transfer belt 31 used in the endurance test is an endless belt made of a polyimide material having a thickness of 65 μm. The transfer material S used in the endurance test is a plain paper having a grammage value of 75 g/m$^2$. In the endurance test, the image forming apparatus illustrated in FIG. 1 performed intermittent image formation that includes continuous printing of full-color images on four consecutive sheets followed by an interruption of the printing during one second.

In the above-described endurance test, the rotational speed of the intermediate transfer belt 31 was set to 180 mm/sec to transfer a toner image. The rotational speed of the intermediate transfer belt 31 was selected from three levels of 180 mm/sec (no speed change), 90 mm/sec, and 60 mm/sec in the engagement and separation of the primary transfer roller. The frictional abrasion of the primary transfer roller 14*a* to 14*d* was evaluated after printing of 50000 sheets. The following table 3 summarizes the evaluation result.

TABLE 3

| | Rotational speed in engagement/separation (mm/sec) | | |
|---|---|---|---|
| | 180 | 90 | 60 |
| Abrasion of primary transfer roller | X | Δ | ○ |
| Diameter of fallen fragmented sponge (μm) | 550 | 300 | — |

In table 3, "○" indicates a state where no frictional abrasion was generated from the primary transfer roller 14*a* to 14*d*, "Δ" indicates a state where a small amount of frictional abrasion was generated from the primary transfer roller 14*a* to 14*d*, and "x" indicates a state where a great amount of frictional abrasion was generated from the primary transfer roller 14*a* to 14*d*.

In a case where the rotational speed of the intermediate transfer belt 31 is set to 180 mm/sec when the primary transfer roller 14*a* to 14*d* is engaged with or separated from the intermediate transfer belt 31, a great amount of fragmented sponge falls from the primary transfer roller 14*a* to 14*d* and adheres to the intermediate transfer belt 31, the driving roller 8, and the counter roller 34. Accordingly, the intermediate transfer belt 31 swelled on each tension roller was confirmed.

In a case where the rotational speed of the intermediate transfer belt 31 is set to 90 mm/sec when the primary transfer roller 14*a* to 14*d* is engaged with or separated from the intermediate transfer belt 31, a small amount of fragmented sponge falls from the primary transfer roller 14*a* to 14*d* and adheres to the driving roller 8 and the counter roller 34. The measured size of the fallen fragmented sponge was only 300 μm.

In a case where the rotational speed of the intermediate transfer belt 31 is set to 60 mm/sec when the primary transfer roller 14*a* to 14*d* is engaged with or separated from the intermediate transfer belt 31, substantially no fragmented sponge falls from the primary transfer roller 14*a* to 14*d*.

Therefore, the endurance test has revealed that setting a slower rotational speed for the intermediate transfer belt 31 in the operation for separating the primary transfer roller 14*a* to 14*d* from the intermediate transfer belt 31 brings an effect of reducing the frictional force acting on the surface of the primary transfer roller 14*a* to 14*d* and reducing the frictional abrasion. Further, the endurance test has revealed that setting a slower rotational speed for the intermediate transfer belt 31 in the operation for engaging the primary transfer roller 14*a* to 14*d* with the intermediate transfer belt 31 brings an effect of reducing the frictional force acting on the surface of the primary transfer roller 14*a* to 14*d* and reducing the frictional abrasion.

Further, the primary transfer roller 14*a* to 14*d* can be engaged with and separated from the intermediate transfer belt 31 without decreasing the rotational speed of the intermediate transfer belt 31 to 0. Therefore, the present exemplary embodiment can prevent the photosensitive drum 2*a* to 2*d* from being abraded and can reduce the time required for the mode switching operation.

Accordingly, the above-described speed control can minimize the time during which the primary transfer roller 14*a* to 14*d* is continuously brought into contact with the intermediate transfer belt 31. Further, above-described speed control can prevent the primary transfer roller 14*a* to 14*d* from being frictionally abraded. Moreover, the above-described speed control can prevent the primary transfer roller 14*a* to 14*d* from being frictionally abraded when the primary transfer roller 14*a* to 14*d* is brought into contact with the intermediate transfer belt 31.

Similar to the above-described operation for a plain paper, when the transfer material S is a thick paper having a grammage value in a range from 106 g/m$^2$ to 128 g/m$^2$, in a case where the operational mode is switched, the rotational speed of the intermediate transfer belt 31 is decreased from 90 mm/sec to 60 mm/sec and then the primary transfer roller 14*a* to 14*d* is engaged or separated.

In the present exemplary embodiment, the rotational speed of the intermediate transfer belt 31 to be set to transfer a toner image may be differentiated between the multicolor mode and the mono-color mode. If the rotational speed of the intermediate transfer belt 31 in the engagement and separation of the primary transfer roller 14*a* to 14*d* is set to a level lower than the rotational speed of the intermediate transfer belt 31 to be set to transfer a toner image in each mode, the load acting on the primary transfer roller 14*a* to 14*d* can be reduced.

As described above, in a case where the transfer material S is a plain paper or a thick paper having a grammage value in a range from 106 g/m$^2$ to 128 g/m$^2$, the rotational speed of the intermediate transfer belt 31 in the engagement or separation of the primary transfer roller 14*a* to 14*d* is set to a lowest speed that can be set by the control unit 101.

The image forming apparatus according to the present exemplary embodiment sets the process speed to 60 mm/sec in a case where the transfer material S is a thick paper having a grammage value in a range from 129 g/m$^2$ to 216 g/m$^2$. The process speed set in this case is the slowest speed (60 mm/sec) that can be set by the control unit 101.

More specifically, in a case where the transfer material S is the thick paper having a grammage value in the range from 129 g/m$^2$ to 216 g/m$^2$, the rotational speed of the intermediate transfer belt 31 in the separation of the primary transfer roller 14*a* to 14*d* is equal to the rotational speed of the intermediate transfer belt 31 to be set to transfer a toner image. Therefore, there is no substantial speed change in the engagement or separation of the primary transfer roller 14*a* to 14*d* when the operational mode is switched.

As described above, in the present exemplary embodiment, the rotational speed of the intermediate transfer belt 31 in the operation for engaging or separating the transfer roller with or from the intermediate transfer belt is set to the lowest rotational speed that can be set by the control unit 101. When the rotational speed of the intermediate transfer belt 31 in the operation for transferring the toner image is faster than the lowest rotational speed, the control for the rotational speed of the intermediate transfer belt 31 in the mode switching operation is performed.

If the rotational speed of the intermediate transfer belt 31 in the operation for transferring a toner image is set to a rotational speed at which no fragmented sponge falls from the transfer roller even when the transfer roller is separated from the intermediate transfer belt, no control is necessary for the rotational speed of the intermediate transfer belt 31 in the mode switching operation to prevent the photosensitive drum from being abraded in the mode switching operation and to prevent the throughput from deteriorating.

Further, as described in the present exemplary embodiment, if the lowest process speed (i.e., 60 mm/sec) is a rotational speed at which no fragmented sponge falls from the transfer roller even when the transfer roller is separated from the intermediate transfer belt, the control unit 101 needs not to newly set a speed level dedicated for the separating operation and can easily perform the control.

As described above, the present exemplary embodiment can reduce the frictional force acting on the primary transfer roller 14*a* to 14*d* by decreasing the rotational speed of the intermediate transfer belt 31. As a result, the present exemplary embodiment can prevent the primary transfer rollers 14*a* to 14*d* from being frictionally abraded.

Figure 6:
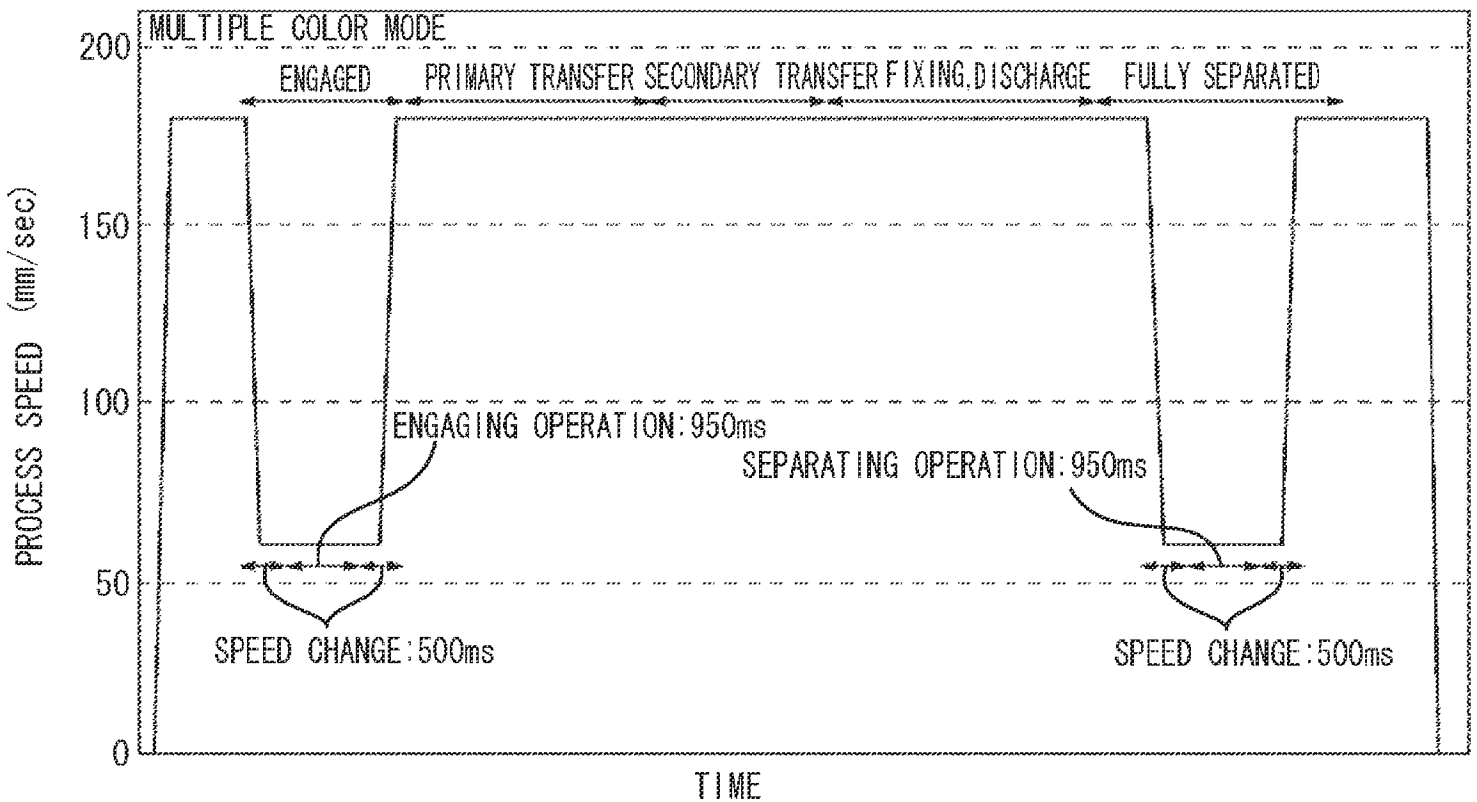
FIG. 6 illustrates an example of speed control for the intermediate transfer belt in the multicolor mode according to the first exemplary embodiment of the present invention.

Further, as illustrated in FIG. 6, the intermediate transfer belt 31 starts changing its speed in an initial duration of 500 ms before starting the operation for engaging (or separating) the primary transfer rollers 14*a* to 14*d*. In an intermediate duration of 950 ms, the primary transfer roller 14*a* to 14*d* is engaged with (or disengaged from) the intermediate transfer belt 31. Then, in a final duration of 500 ms, the primary transfer rollers 14*a* to 14*d* change process speed to a level to be set in a predetermined image formation mode. Minimizing the time width required to reduce the speed as described above is effective to suppress reduction in the printing speed of the image forming apparatus or reduce adverse influence on other control timing.

Figure 7:
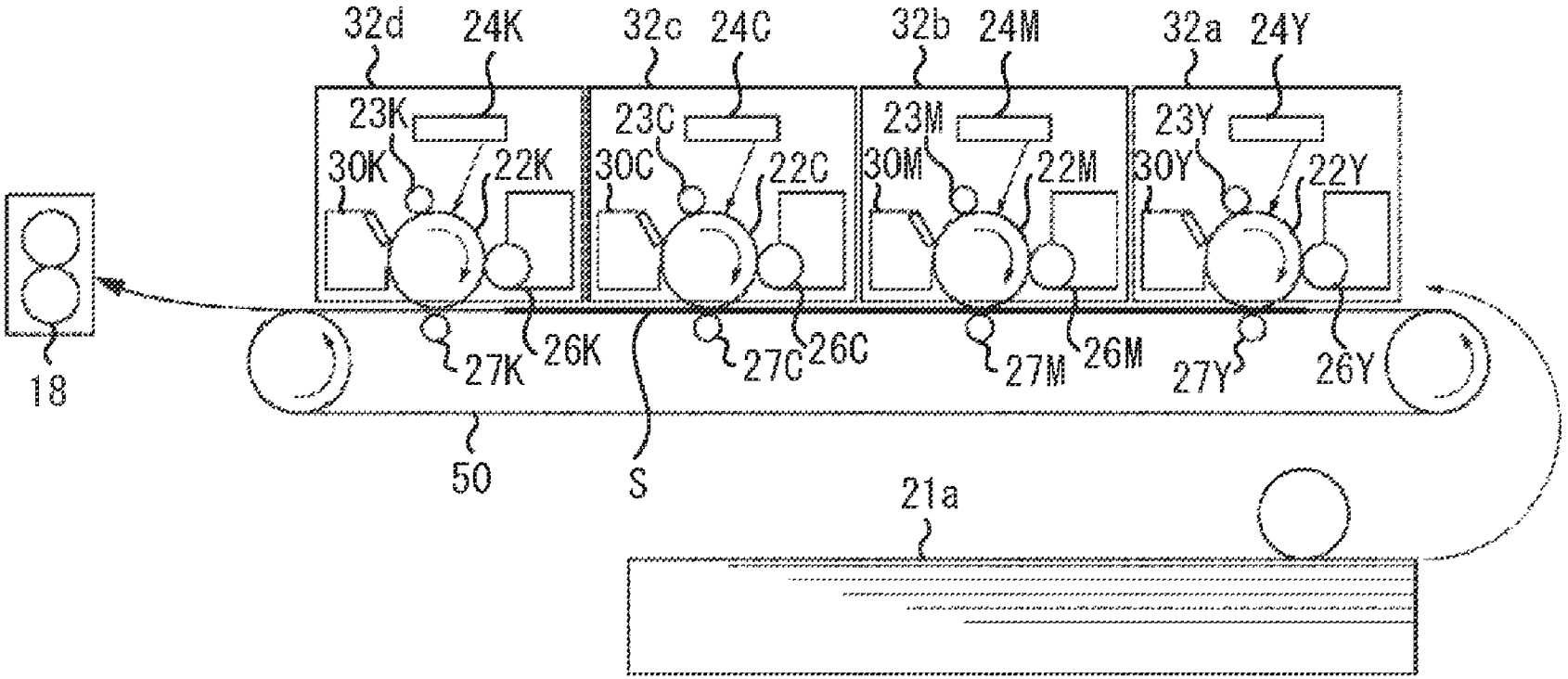
FIG. 7 illustrates an example of a schematic cross-sectional configuration of an image forming apparatus including a mechanism using a transfer material conveyance belt according to the first exemplary embodiment of the present invention.

Moreover, similar effects can be obtained if the speed control according to the present exemplary embodiment is performed for a color image forming apparatus including a transfer material conveyance belt illustrated in FIG. 7, which includes image formation units of respective colors configured to sequentially transfer toner images to a transfer material while electrostatically absorbing and conveying the transfer material using a belt-like conveyance member 50.

The image forming apparatus illustrated in FIG. 7 includes a plurality of image forming units 32. Each image forming unit 32 includes a photosensitive drum 22 serving as an image carrier, a charging member 23 that can charge the photosensitive drum 22, an exposure unit 24 configured to form an electrostatic latent image on the photosensitive drum 22, and a developing roller 26 that can develop an electrostatic latent image, in addition to a transfer material conveyance belt 33. A transfer roller 27, which is a transfer member for each image forming unit 32, can be engaged with and separated from the transfer material conveyance belt 50 according to a mode switching operation. The transfer material S is fed to the transfer material conveyance belt 50 via a roller from paper tray 21*a*.

In the multicolor mode, the image forming apparatus transfers toner images to a transfer material conveyed by the transfer material conveyance belt 50 in a state where a nip portion is formed between a first transfer member (i.e., transfer rollers 27Y, 27M, and 27C) and a first image carrier (i.e., photosensitive drums 22Y, 22M, and 22C) via the transfer material conveyance belt 50, and further in a state where a nip portion is formed between a second transfer member (i.e., transfer roller 27K) and a second image carrier (photosensitive drum 22K) via the transfer material conveyance belt 50.

In the mono-color mode, the image forming apparatus transfers a toner image to a transfer material conveyed by the transfer material conveyance belt 50 in a state where the first transfer member (i.e., the transfer rollers 27Y, 27M, and 27C) is separated from the transfer material conveyance belt 50 and further in a state where the nip portion is formed between the second transfer member (i.e., the transfer roller 27K) and the second image carrier (i.e., the photosensitive drum 22K) via the transfer material conveyance belt 50.

To prevent the transfer member from being frictionally abraded by the transfer material conveyance belt in the mode switching operation, the transfer material conveyance belt type image forming apparatus can perform speed control similar to the above-described control for the intermediate transfer belt type image forming apparatus.

An inline color image forming apparatus according to another exemplary embodiment includes an intermediate transfer belt and a primary transfer member that has a film member to which a voltage is applied. The image forming apparatus according to the present exemplary embodiment is not different in configuration from the image forming apparatus described in the first exemplary embodiment except that the primary transfer member includes the film member not driven (rotated) by the intermediate transfer belt 31 and contacting the inner circumferential surface of the intermediate transfer belt 31.

Figure 8:
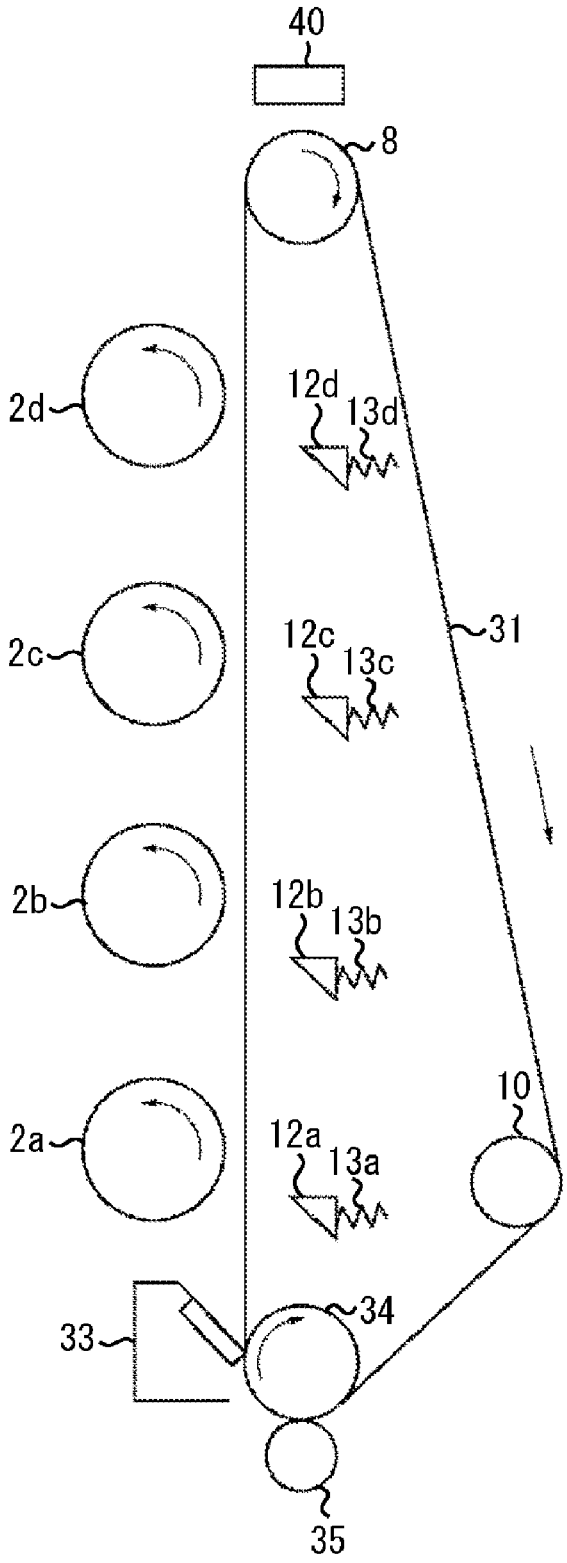
FIG. 8 illustrates an example of a schematic cross-sectional configuration of an image forming apparatus according to a second exemplary embodiment of the present invention.
Figure 9:
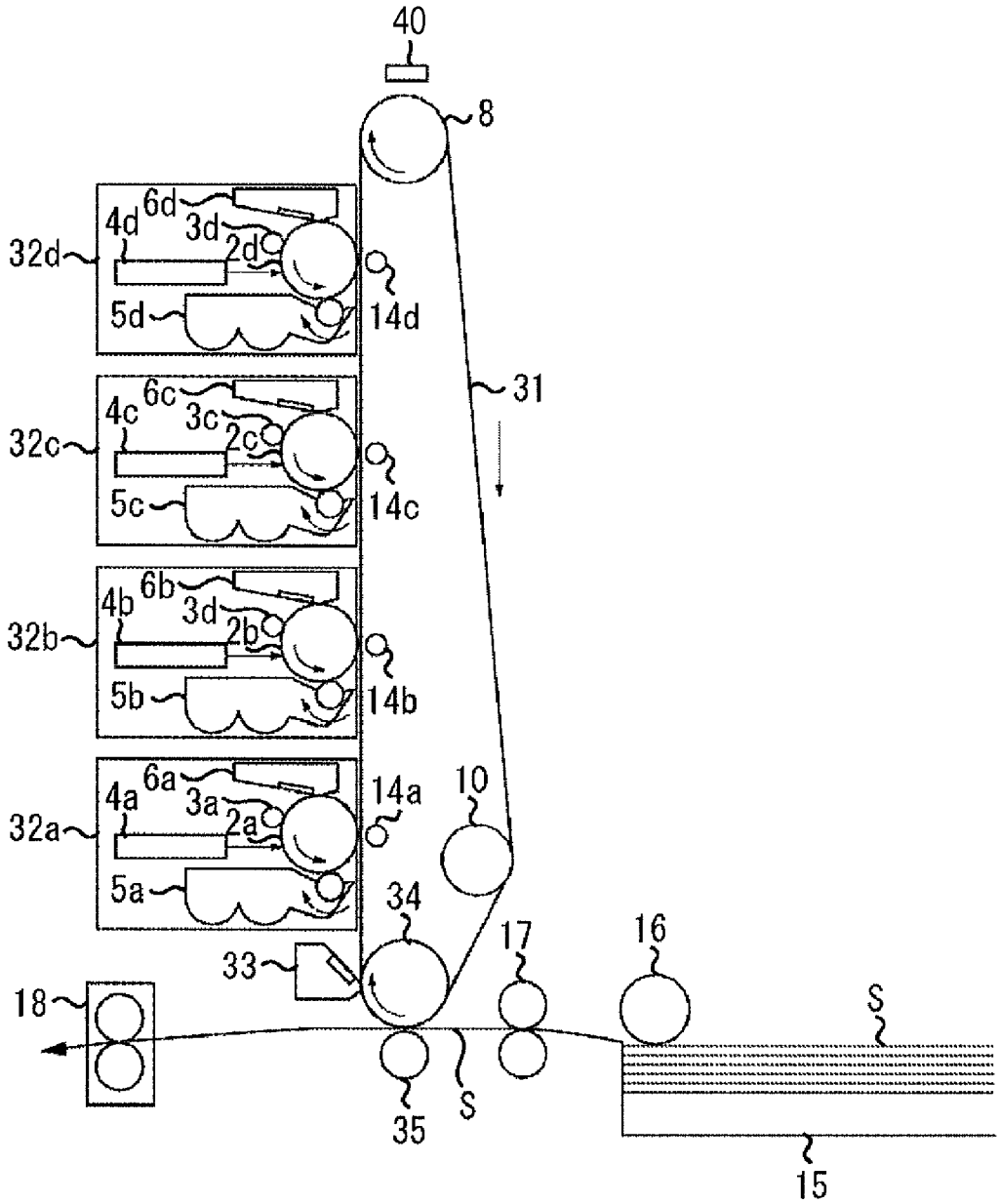
FIG. 9 (PRIOR ART)
FIG. 9 illustrates an overall configuration of a conventional color image forming apparatus.

FIG. 8 illustrates an example of a configuration of an intermediate transfer member according to the present exemplary embodiment. The primary transfer member is made of a high-molecular polyethylene film member containing carbon additives. The thickness is 200 μm. The resistance is a specific volume resistance equal to or less than $10^5$ Ω·cm.

Each film member 12 (12*a*, 12*b*, 12*c*, 12*d*) has an end portion fixed to a supporting member 13 (13*a*, 13*b*, 13*c*, 13*d*). A pressing member, such as a pressing spring (not illustrated), is connected to the supporting member 13. The film member 12 can be engaged with the intermediate transfer belt 31 when the pressing member applies a predetermined amount of resilient force to the film member 12. The film member 12 can be separated from the intermediate transfer belt 31 when the pressing member does not apply a predetermined amount of resilient force to the film member 12. In an operation for primarily transferring a toner image from the photosensitive drum 2*a* to 2*d* to the intermediate transfer belt 31, a voltage supply source (not illustrated) applies a desired amount of voltage to the film member 12. In this state, a toner image can be primarily transferred to the intermediate transfer belt 31.

The image forming apparatus according to the present exemplary embodiment has a configuration and a control method for image formation similar to those of the color image forming apparatus according to the first exemplary embodiment. The image forming apparatus according to the present exemplary embodiment can operate at a process speed selected from three speed modes of 180 mm/sec, 90 mm/sec, and 60 mm/sec according to the transfer material S.

The image forming apparatus according to the present exemplary embodiment performs control for a primary transfer to the intermediate transfer belt 31, which is similar to the control described in the first exemplary embodiment. First, the image forming apparatus starts driving the intermediate transfer belt 31 to rotate in a predetermined direction at a process speed corresponding to the transfer material S. In a state where the rotational speed of the intermediate transfer belt 31 is once changed to 60 mm/sec, the film member 12 having one end fixed (i.e., the primary transfer member) is brought into contact with the intermediate transfer belt 31.

After the above-described engaging operation is completed, the image forming apparatus returns the rotational speed of the intermediate transfer belt 31 to a predetermined level in a duration of 500 ms. Then, the image forming apparatus applies a primary transfer voltage to the film member 12 to primarily transfer a toner image from the photosensitive drum 2*a* to 2*d* to the intermediate transfer belt 31.

Similar to the first exemplary embodiment, after the image formation processing is completed, the image forming apparatus starts changing the rotational speed of the intermediate transfer belt 31 to 60 mm/sec from 500 ms before the film member 12 starts a separating operation. Then, the image forming apparatus separates the film member 12 from the intermediate transfer belt 31 in a state where the frictional force applied to the film member 12 is decreased.

An example of speed control for the intermediate transfer belt in a switching operation from the multicolor mode to the mono-color mode, which is similar to that described in the first exemplary embodiment, is described with reference to FIG. 5.

At the moment when the image forming apparatus completes the image formation on a plain paper in the multicolor mode, the intermediate transfer belt is rotating at 180 mm/sec. When the operation mode is switched to the mono-color mode, the control unit 101 decreases the rotational speed of the intermediate transfer belt 31 to 60 mm/sec.

In the state where the rotational speed of the intermediate transfer belt 31 is set to 60 mm/sec, the image forming apparatus separates the film members 12*a*, 12*b*, and 12*c* from the intermediate transfer belt 31 because the film members 12*a*, 12*b*, and 12*c* are not used in the mono-color mode. After the film members 12*a*, 12*b*, and 12*c* are separated from the intermediate transfer belt 31, the control unit 101 changes the rotational speed of the intermediate transfer belt 31 to 180 mm/sec, which is a rotational speed to be set when the image forming apparatus performs image formation on a plain paper in the mono-color mode.

The film member 12 serving as the primary transfer member is different from the primary transfer member described in the first exemplary embodiment in that the film member 12 is not driven by the intermediate transfer belt 31 to rotate in a predetermined direction. As the film member 12 does not rotate relative to the intermediate transfer belt 31, the film member 12 tends to be easily abraded due to a frictional engagement compared to the roller described in the first exemplary embodiment.

Further, compared to the above-described roller member whose surface may be frictionally abraded and a fragment of which may adhere to a reverse surface of the intermediate transfer belt, the film member not only tends to be frictionally abraded and adheres to the reverse surface of the intermediate transfer belt but also may induce transfer failures due to frictional abrasion of the film member.

On the other hand, the above-described control according to the present exemplary embodiment reduces the circumferential speed of the intermediate transfer belt in the operation for engaging or separating the primary transfer member to or from the intermediate transfer belt. Therefore, the present exemplary embodiment can reduce the frictional load and can prevent the primary transfer member from being frictionally abraded.

The present exemplary embodiment uses a film member as the primary transfer member. Any other elastic member having a surface that is continuously brought into frictionally engagement with the inner circumferential surface of the intermediate transfer belt 31 can be used as the primary transfer member to obtain effects similar to those obtained according to the above-described speed control.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2008-250527 filed Sep. 29, 2008 and No. 2009-213340 filed Sep. 15, 2009, which are hereby incorporated by reference herein in their entirety.

What is claimed is:

1. An image forming apparatus, comprising:

a rotatable intermediate transfer belt;

a first image carrier and a second image carrier each configured to carry a toner image, wherein the first image carrier and the second image carrier are located in a confronting relationship with the intermediate transfer belt and disposed along a rotational direction of the intermediate transfer belt;

a first transfer member arranged on an opposite side of the intermediate transfer belt from the first image carrier; and a second transfer member arranged on an opposite side of the intermediate transfer belt from the second image carrier, wherein the image forming apparatus is configured to be switchable between a multicolor mode and a mono-color mode, cause, in the multicolor mode, the first image carrier and the first transfer member to be urged towards each other to allow transfer of toner images from the first image carrier onto the intermediate transfer belt, and the second image carrier and the second transfer member to be urged towards each other to allow transfer of toner images from the second image carrier onto the intermediate transfer belt, and then the intermediate transfer belt to secondarily transfer the superimposed toner images to a transfer material, and cause, in the mono-color mode, the second image carrier and the second transfer member to be urged towards each other to allow transfer of toner images from the second image carrier onto the intermediate transfer belt in a state where the first transfer member is separated from the intermediate transfer belt, and then the intermediate transfer belt to secondarily transfer the transferred toner image to the transfer material, wherein in that the image forming apparatus is configured to change a rotational speed of the intermediate transfer belt to a speed slower than a rotational speed of the intermediate transfer belt used in the multicolor mode during transfer of the toner image to the intermediate transfer belt in a case that the operational mode is switched from the multicolor mode to the mono-color mode, separate the first transfer member from the intermediate transfer belt, and increase, after the first transfer member is separated from the intermediate transfer belt, the rotational speed of the intermediate transfer belt to a rotational speed used in the mono-color mode to transfer the toner image to the intermediate transfer belt.

2. The image forming apparatus according to claim 1 configured so that, in a case that the operational mode is switched from the mono-color mode to the multicolor mode, the image forming apparatus changes the rotational speed of the intermediate transfer belt to the slower rotational speed from the rotational speed of the intermediate transfer belt to be used in the mono-color mode to transfer the toner image to the intermediate transfer belt, then brings the first transfer member into contact with the intermediate transfer belt, and after the first transfer member contacts the intermediate transfer belt, the image forming apparatus increases the rotational speed of the intermediate transfer belt to the rotational speed of the intermediate transfer belt to be used in the multicolor mode to transfer the toner image to the intermediate transfer belt.

3. The image forming apparatus according to claim 1, wherein the first transfer member is a transfer roller that can be driven by the intermediate transfer belt when the intermediate transfer belt rotates.

4. The image forming apparatus according to claim 1, where the first transfer member includes a film member having one end fixed and frictionally engaged with the intermediate transfer belt, and a supporting member that can support the film member.

5. The image forming apparatus according to claim 1, further comprising a control unit configured to control the rotational speed of the intermediate transfer belt, wherein the control unit can switch the rotational speed of the intermediate transfer belt between a plurality of speed levels, and the slower rotational speed is equivalent to a lowest level of the rotational speed of the intermediate transfer belt that can be rotated by the control unit.

6. The image forming apparatus according to claim 1, further comprising a control unit configured to control a rotational speed of the intermediate transfer belt, wherein the control unit can switch the rotational speed of the intermediate transfer belt between a plurality of speed levels, and the slower rotational speed is equivalent to a lowest level of the rotational speed of the intermediate transfer belt that can be rotated by the control unit, wherein the image forming apparatus is configured to separate the first transfer member from the intermediate transfer belt without changing the rotational speed of the intermediate transfer belt when the operational mode is switched from the multicolor mode to the mono-color mode in a case where the rotational speed of the intermediate transfer belt to be used in the multicolor mode to transfer the toner image to the intermediate transfer belts is equivalent to a lowest level of the rotational speed of the intermediate transfer belt that can be realized by the control unit.

7. An image forming apparatus, comprising:

a rotatable intermediate transfer belt;

a first image carrier and a second image carrier each configured to carry a toner image, wherein the first image carrier and the second image carrier are located in a confronting relationship with the intermediate transfer belt and disposed along a rotational direction of the intermediate transfer belt;

a first transfer member arranged on an opposite side of the intermediate transfer belt from the first image carrier; and a second transfer member arranged on an opposite side of the intermediate transfer belt from the second image carrier, wherein a rotational speed of the intermediate transfer belt can be switched between a first speed that is equivalent to a rotational speed of the intermediate transfer belt to be used when the toner image is transferred to the intermediate transfer belt and a second speed that is slower than the first speed, and in a case that the image forming apparatus separates the first transfer member from the intermediate transfer belt, the image forming apparatus changes the rotational speed of the intermediate transfer belt from the first speed to the second speed, and then separates the first transfer member from the intermediate transfer belt while the intermediate transfer belt rotates at the second speed.

8. An image forming apparatus, comprising:

a rotatable transfer material conveyance belt;

a first image carrier and a second image carrier each configured to carry a toner image, wherein the first image carrier and the second image carrier are located in a confronting relationship with the transfer material conveyance belt and disposed along a rotational direction of the transfer material conveyance belt;

a first transfer member arranged on an opposite side of the transfer material conveyance belt from the first image carrier; and a second transfer member arranged on an opposite side of the transfer material conveyance belt from the second image carrier, wherein the image forming apparatus is configured to be switchable between a multicolor mode and a mono-color mode, cause, in the multicolor mode, the first image carrier and the first transfer member to be urged towards each other to allow transfer of toner images from the first image carrier onto a transfer material conveyed by the transfer material conveyance belt, and the second image carrier and the second transfer member to be urged towards each other to allow transfer of toner images from the second image carrier onto the transfer material conveyed by the transfer material conveyance belt, and cause, in the mono-color mode, the second image carrier and the second transfer member to be urged towards each other to allow transfer toner images onto the transfer material carried by the transfer material conveyance belt in a state where the first transfer member is separated from the transfer material conveyance belt, wherein the image forming apparatus is configured to change a rotational speed of the transfer material conveyance belt to a speed slower than a rotational speed of the transfer material conveyance belt to be used in the multicolor mode during transfer of the toner image to the transfer material in a case that the operational mode is switched from the multicolor mode to the mono-color mode, separate the first transfer member from the transfer material conveyance belt, and increase, after the first transfer member is separated from the transfer material conveyance belt, the rotational speed of the transfer material conveyance belt to a rotational speed used in the mono-color mode to transfer the toner image to the transfer material conveyance belt.

9. The image forming apparatus according to claim 8, configured so that, when the operational mode is switched from the mono-color mode to the multicolor mode, the image forming apparatus changes the rotational speed of the transfer material conveyance belt to the slower rotational speed from the rotational speed of the transfer material conveyance belt to be used in the mono-color mode to transfer the toner image to the transfer material, then brings the first transfer member into contact with the transfer material conveyance belt, and after the first transfer member contacts the transfer material conveyance belt, increases the rotational speed of the transfer material conveyance belt to the rotational speed of the transfer material conveyance belt used in the multicolor mode to transfer the toner image to the transfer material.

10. The image forming apparatus according to claim 8, wherein the first transfer member is a transfer roller that can be driven by the transfer material conveyance belt when the transfer material conveyance belt rotates.

11. The image forming apparatus according to claim 8, further comprising a control unit configured to control a rotational speed of the transfer material conveyance belt, wherein the control unit can switch the rotational speed of the transfer material conveyance belt between a plurality of speed levels, the slower rotational speed being equivalent to a lowest level of the rotational speed of the transfer material conveyance belt that can be realized by the control unit.

12. The image forming apparatus according to claim 8, further comprising a control unit configured to control the rotational speed of the transfer material conveyance belt, wherein the control unit can switch the rotational speed of the transfer material conveyance belt between a plurality of speed levels, the slower rotational speed being equivalent to a lowest level of the rotational speed of the transfer material conveyance belt that can be realized by the control unit, wherein the image forming apparatus is configured to separate the first transfer member from the transfer material conveyance belt without changing the rotational speed of the transfer material conveyance belt when the operational mode is switched from the multicolor mode to the mono-color mode in a case where the rotational speed of the transfer material conveyance belt to be used in the multicolor mode to transfer the toner image to the transfer material is equivalent to the lowest level of the rotational speed of the transfer material conveyance belt that can be realized by the control unit.

13. An image forming apparatus, comprising:

a rotatable transfer material conveyance belt;

a first image carrier and a second image carrier each configured to carry a toner image, wherein the first image carrier and the second image carrier are located in a confronting relationship with the transfer material conveyance belt and disposed along a rotational direction of the transfer material conveyance belt;

a first transfer member arranged on an opposite side of the intermediate transfer belt from the first image carrier and a second transfer member arranged on an opposite side of the intermediate transfer belt from the second image carrier, wherein a rotational speed of the transfer material conveyance belt can be switched between a first speed that is equivalent to a rotational speed of the transfer material conveyance belt to be used when the toner image is transferred to the transfer material and a second speed that is slower than the first speed, and in a case that the image forming apparatus separates the first transfer member from the transfer material conveyance belt, the image forming apparatus changes the rotational speed of the transfer material conveyance belt from the first speed to the second speed, and then separates the first transfer member from the transfer material conveyance belt rotating at the second speed.

* * * * *